US009932208B2

(12) United States Patent
Mealy

(10) Patent No.: US 9,932,208 B2
(45) Date of Patent: Apr. 3, 2018

(54) LIFTING HARNESS

(71) Applicant: E-Z Barrow LLC, Las Vegas, NV (US)

(72) Inventor: Douglas Ray Mealy, Las Vegas, NV (US)

(73) Assignee: E-Z Barrow LLC, Las Vegas, NV (US)

( * ) Notice: Subject to any disclaimer, the term of this patent is extended or adjusted under 35 U.S.C. 154(b) by 0 days.

(21) Appl. No.: 15/668,198

(22) Filed: Aug. 3, 2017

(65) Prior Publication Data

US 2018/0037442 A1 Feb. 8, 2018

Related U.S. Application Data

(60) Provisional application No. 62/370,608, filed on Aug. 3, 2016.

(51) Int. Cl.

| | |
|---|---|
| ***A45F 3/14*** | (2006.01) |
| ***B66C 1/14*** | (2006.01) |
| ***A62B 35/00*** | (2006.01) |
| *B66C 1/00* | (2006.01) |

(52) U.S. Cl.

CPC ..... *B66C 1/14* (2013.01); *A62B 35/0037* (2013.01); *A62B 35/0075* (2013.01); *A62B 35/00* (2013.01); *B66C 1/00* (2013.01)

(58) Field of Classification Search

CPC ..... A45F 3/14; A45F 3/04; A45F 2003/146; A45F 2003/142; A45F 2003/045; A45F 3/08; A41D 13/0007; B65G 7/12

See application file for complete search history.

(56) References Cited

U.S. PATENT DOCUMENTS

| | | | | |
|---|---|---|---|---|
| 1,879,480 | A * | 9/1932 | Pures | A45F 3/14 224/260 |
| 2,431,780 | A * | 12/1947 | Theal | A45F 3/14 224/157 |
| 6,006,970 | A * | 12/1999 | Piatt | A45F 3/14 224/257 |
| 6,035,440 | A | 3/2000 | Woodyard | |
| 6,233,740 | B1 * | 5/2001 | Meyers | A41D 13/0007 2/102 |
| 6,508,389 | B1 * | 1/2003 | Ripoyla | A45F 3/14 182/3 |
| 6,729,511 | B2 | 5/2004 | Dent, III | |

(Continued)

*Primary Examiner* — Corey Skurdal

(74) *Attorney, Agent, or Firm* — Howard & Howard Attorneys PLLC

(57) ABSTRACT

A lifting harness is described herein. The lifting harness includes a waist belt adapted to extend around a waistline of a user and a shoulder support assembly coupled to the waist belt. The shoulder support assembly is adapted to extend across each shoulder of the user and includes a pair of shoulder support straps. A pair of lifting strap assemblies is coupled to the shoulder support assembly. Each lifting strap assembly includes a lifting strap having a first end, a middle portion, and a second end. The middle portion is coupled to a corresponding shoulder support strap and adapted to extend across a corresponding shoulder of the user. The first end is coupled to the second end to form a shoulder loop. An attachment device is coupled to the first end of the lifting strap. A lifting device is detachably coupled to the attachment device.

20 Claims, 12 Drawing Sheets

(56) References Cited

U.S. PATENT DOCUMENTS

| | | | | |
|---|---|---|---|---|
| 7,051,910 | B2 * | 5/2006 | Sprague | A45C 13/30<br>224/262 |
| 8,430,204 | B1 * | 4/2013 | Reynolds | A62B 35/0006<br>182/3 |
| 8,657,166 | B1 * | 2/2014 | Harness | A45F 5/021<br>224/259 |
| 2009/0014483 | A1 * | 1/2009 | Green | A41D 13/0007<br>224/157 |

* cited by examiner

LIFTING HARNESS

CROSS-REFERENCE TO RELATED APPLICATION

This application claims benefit of U.S. Provisional Patent Application Ser. No. 62/370,608, filed Aug. 3, 2016, the disclosure of which is hereby incorporated by reference in its entirety.

TECHNICAL FIELD

The subject matter disclosed herein relates generally to lifting harness, and more particularly, to a lifting harness adapted to allow workers to lift heavy objects such as wheelbarrows.

BACKGROUND OF THE INVENTION

Harnesses have been around for many years for safety purposes and used for many different kinds of jobs in construction, landscaping, farming and electrical. At least one known harnesses are fabricated of a strong webbing fabric and include a combination of straps that wrap the user's torso and legs, including various points of attachments. For example, at least some known harnesses include a ring or other coupling mechanism is incorporated into the harness webbing to which the lanyard is attached. However, at least some of these coupling mechanisms are inconvenient for the wearer and sometimes difficult to put on. In addition, at least some known products, such as the Forearm Forklift Extension Strap™ and the Wheelbarrow Support Strap™, consist of straps that are used for lifting by using the arms or the neck which can cause damage to your body by putting all the weight on the arms or neck. The present invention is aimed at the addressing the needs identified above.

SUMMARY OF THE INVENTION

In one aspect of the present invention, a lifting harness is provided. The lifting harness includes a waist belt adapted to extend around a waistline of a user and a shoulder support assembly coupled to the waist belt. The shoulder support assembly is adapted to extend across each shoulder of the user and includes a pair of shoulder support straps. Each shoulder support strap extending between a first end coupled to a front end of the waist belt and a second end coupled to a back end of the waist belt. A pair of lifting strap assemblies is coupled to the shoulder support assembly. Each lifting strap assembly includes a lifting strap that is coupled to a corresponding shoulder support strap. The lifting strap includes a first end, a middle portion, and a second end. The middle portion is coupled to the corresponding shoulder support strap and adapted to extend across a corresponding shoulder of the user. The first end is coupled to the second end to form a shoulder loop. An attachment device is coupled to the first end of the lifting strap. A lifting device is detachably coupled to the attachment device.

In another aspect of the present invention, a safety vest assembly is provided. The safety vest assembly includes a safety vest and a lifting harness coupled to an inner lining of the safety vest. The lifting harness includes a waist belt adapted to extend around a waistline of a user and a shoulder support assembly that is coupled to the waist belt and adapted to extend across each shoulder of the user. The shoulder support assembly includes a pair of shoulder support straps. Each shoulder support strap extends between a first end coupled to a front end of the waist belt and a second end coupled to a back end of the waist belt. A pair of lifting strap assemblies is coupled to the shoulder support assembly. Each lifting strap assembly includes a lifting strap coupled to a corresponding shoulder support strap. The lifting strap has a first end, a middle portion, and a second end. The middle portion is coupled to the corresponding shoulder support strap and adapted to extend across a corresponding shoulder of the user. The first end is coupled to the second end to form a shoulder loop. An attachment device is coupled to the first end of the lifting strap. A lifting device detachably coupled to the attachment device. A pair of support pads coupled to the shoulder support assembly. Each support pad of the pair of support pads is coupled to a corresponding shoulder support strap and positioned between a corresponding shoulder of the user and the corresponding shoulder support strap. Each support pad includes an outer surface coupled to the inner lining of the safety vest.

In a further aspect of the present invention, a method of assembling a lifting harness is provided. The method includes the steps of providing a waist belt adapted to extend around a waistline of a user and coupling a shoulder support assembly to the waist belt. The shoulder support assembly including a pair of shoulder support straps. Each shoulder support strap extends between a first end coupled to a front end of the waist belt and a second end coupled to a back end of the waist belt. The method includes coupling a pair of lifting strap assemblies to the shoulder support assembly. Each lifting strap assembly includes a lifting strap coupled to a corresponding shoulder support strap. The lifting strap has a first end, a middle portion, and a second end. The middle portion is coupled to the corresponding shoulder support strap and adapted to extend across a corresponding shoulder of the user. The first end is coupled to the second end to form a shoulder loop. An attachment device is coupled to the first end of the lifting strap. A lifting device is detachably coupled to the attachment device.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
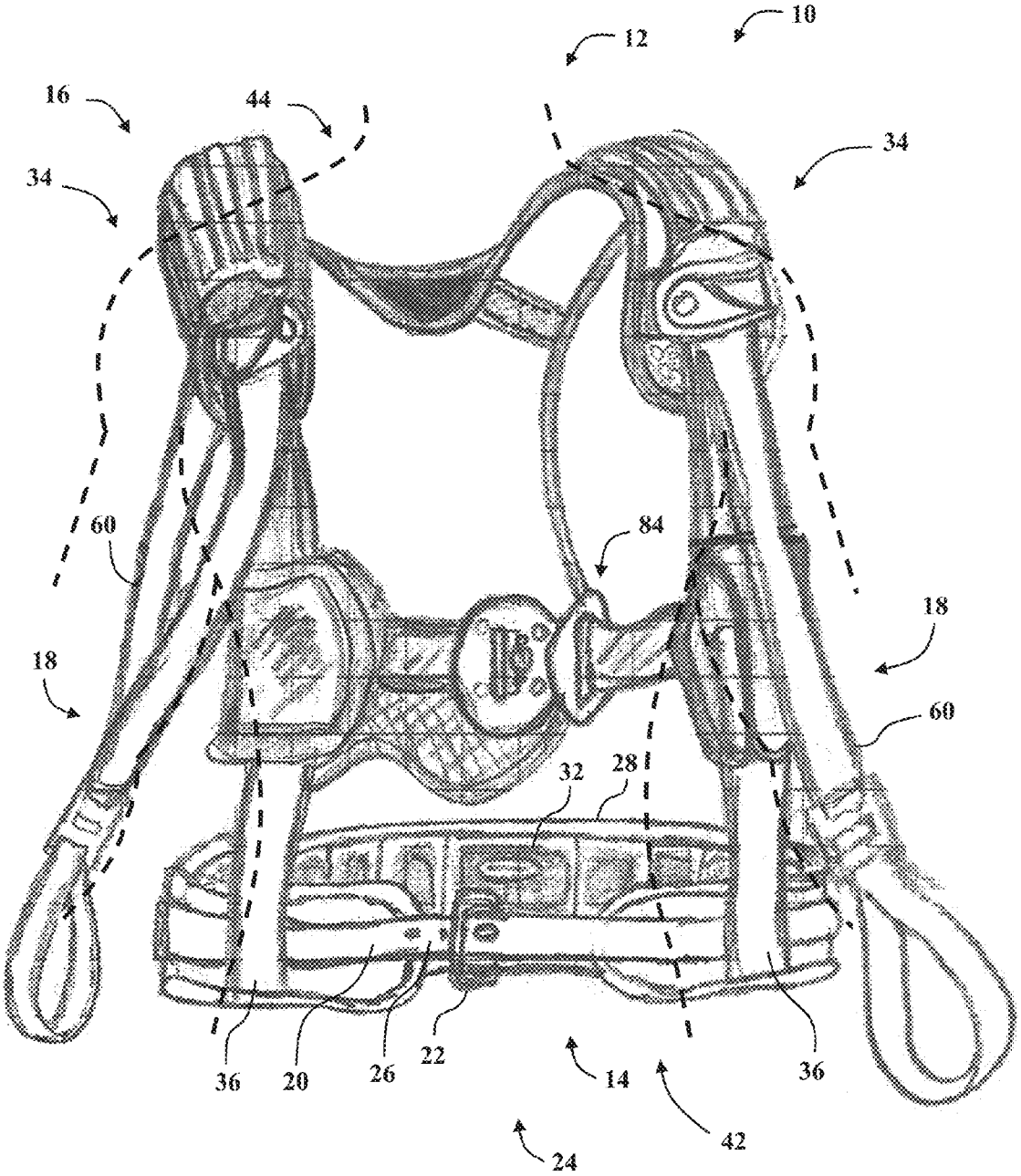
FIG. 1 is a front perspective view of a lifting assembly, according to an embodiment of the present invention.

With reference to the drawings and in operation, the invention overcomes at least some disadvantages of known harnesses by providing a lifting harness that includes a shoulder support assembly and a pair of lifting strap assemblies that are coupled to the shoulder strap assembly to allow a user to lift heavy objects having a portion of the object weight supported by the user's shoulders.

In general, the present invention includes a lifting harness for the use of a wheel barrow for safe lifting as well as other uses for safe lifting other objects like furniture, appliances, windows, piping, hay bales etc. The lifting harness may be used for lifting purposes and can be used by men and women in many different fields of work. The lifting harness may also be used as an attachment under Military body armor for lifting the injured personnel on the cots. Military body armor has been around for years to help save the lives of our military. The lifting harness may be added underneath an armored vest to be used with lifting up cots which gives the men/women a chance to defend themselves as needed.

In general, the present invention provides a lifting harness that enables a user to lift wheel barrows and other objects by putting the weight at the center core of the user's body. The lifting harness is unlike other products, such as the Forearm Forklift Extension Strap™ and the Wheelbarrow Support Strap™, that consist of straps that are used for lifting by using your arms or your neck which can cause damage to your body by putting all the weight on your arms or neck. The lifting harness of the present invention includes attachments like stir ups and different types of hooks that hook onto an object which is then lifted with the body leaving the hands and arms free to maneuver the object to where it is needed to go for better stability. The straps are all strategically connected together with shoulder/back cushions as well as a back support to help prevent injury when lifting. In one embodiment, the stirrups are adapted to be used around the handles of a wheel barrow to help lift. Bailing hook attachments may be used to hook into bales of hay for lifting them up. The multi hook attachments can be used with vacuum cups to lift up windows etc., used with straps for lifting furniture/appliances and also can be used to hold pipes for cutting/welding. This allows users to have their hands free.

In one embodiment, the lifting harness may be attached on the inside of the military body armor vest to help with lifting up cots carrying injured personnel. The straps can be cinched tight so if needed users will have their hands free to defend themselves against the enemy without having to put the injured down.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a front perspective view of a lifting harness 10 that is adapted to be worn by a human 12 for use in lifting objects having a portion of the object weight being supported by the users shoulders. FIGS. 2-6 are various views of the lifting harness 10. In the illustrated embodiment, the lifting harness 10 includes a waist belt 14, a shoulder support assembly 16, and a pair of lifting strap assemblies 18. The waist belt 14 is adapted to extend around a waistline of the user 12. In the illustrated embodiment, the waist belt 14 includes an adjustable harness belt 20 including a center belt buckle 22 positioned at a front end 24 of the waist belt 14. The center belt buckle 22 is attached to an end of a belt strap 26 to enable a user to adjust a diameter of the waist belt 14 to enable the waist belt 14 to be worn by users having different waistline sizes. The waist belt 14 also includes a back brace support pad 28 that extends around a back end 30 of the waist belt 14. The back brace support pad 28 is coupled to the belt strap 26 to provide additional back support to the user. The adjustable harness belt 20 fits different size people for support with the back brace support pad 28. In one embodiment, the harness belt 20 includes a 2-inch wide belt. The back brace support pad 28 includes a plurality of gel-padded pockets 32 spaced along the back support pad 28 to provide a comfort fit for the user. The gel padded back support helps prevent injuries to the user's back when lifting.

The shoulder support assembly 16 is coupled to the waist belt 14 and is adapted to extend across each shoulder 34 of the user 12. The shoulder support assembly 16 extends upwardly from the waist belt 14 from the front end 24 to the back end 30 such that an apex of the shoulder support assembly 16 is positioned adjacent to the user's shoulders 34 when the user is wearing the lifting harness 10. In the illustrated embodiment, the shoulder support assembly 16 includes a pair of shoulder support straps 36. Each shoulder support strap 36 extends between a first end 38 and a second end 40. The first end 38 is coupled to the front end 24 of the waist belt 14. The second end 40 is coupled to the back end 30 of the waist belt 14. In one embodiment, the shoulder support strap 36 includes a 2-inch wide nylon strap having the first end 38 and the second end 40 sewn to the harness belt 20.

Figure 2:
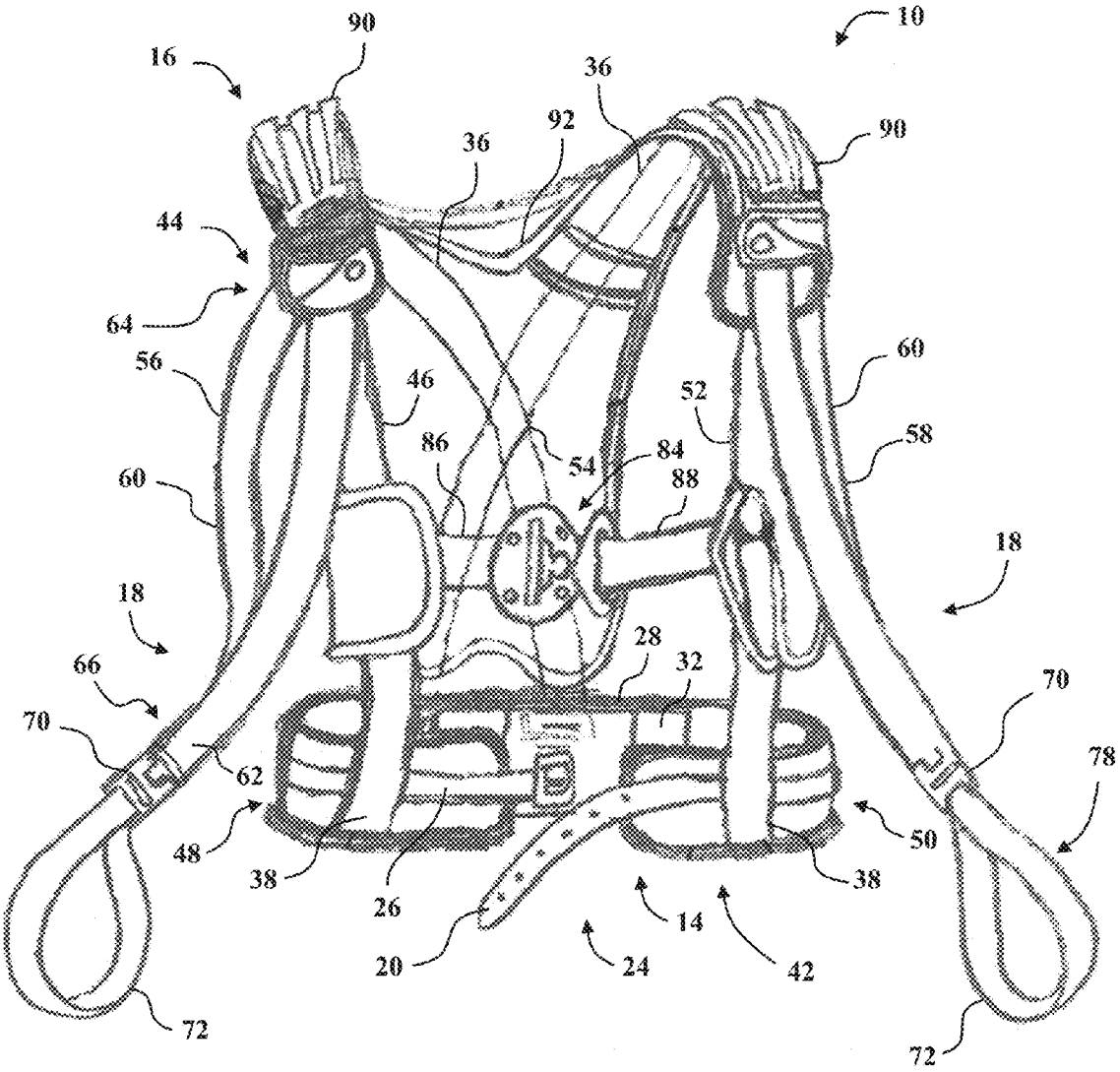
FIG. 2 is another front perspective view of the lifting assembly shown in FIG. 1, according to an embodiment of the present invention.

In one embodiment, each shoulder support strap 36 includes the first end 38 and the second end 40 coupled to opposing sides of the waist belt 14 such that the pair of shoulder support straps are orientated parallel along a front portion 42 of the shoulder support assembly 16 and intersect along a rear portion 44 of the shoulder support assembly 16. For example, as shown in FIG. 2, in one embodiment, the shoulder support assembly 16 includes a first shoulder support strap 46 having a first end coupled to a right side 48 of the front end 24 of the waist belt 14 and a second end coupled to a left side 50 of the back end 30 of the waist belt 14, and a second shoulder support strap 52 having a first end coupled to the left side 50 of the front end 24 of the waist belt 14 and a second end coupled to the right side 48 of the back end 30 of the waist belt 14. In one embodiment, the first shoulder support strap 46 is attached to the second shoulder support strap 52 at an intersection point 54 along the rear portion 44 of the shoulder support assembly 16.

In the illustrated embodiment, the pair of lifting strap assemblies 18 is coupled to the shoulder support assembly 16. The pair of lifting strap assemblies 18 includes a first lifting strap assembly 56 that is coupled to the first shoulder support strap 46 and a second lifting strap assembly 58 that is coupled to the second shoulder support strap 52. Each lifting strap assembly 18 includes a lifting strap 60 that is coupled to a corresponding shoulder support strap 36. Each lifting strap 60 includes a first end 62, a middle portion 64, and a second end 66. The middle portion 64 is coupled to the corresponding shoulder support strap 36 and is adapted to extend across a corresponding shoulder 34 of the user. The first end 62 and the second end 66 are coupled together to form a shoulder loop 68 (shown in FIG. 5) that is sized and shaped to allow a user's arm to extend through the shoulder loop 68. In one embodiment, each lifting strap 60 includes a 1-inch wide nylon strap. In another embodiment, each lifting strap 60 includes a 2-inch wide nylon strap.

Figure 3:
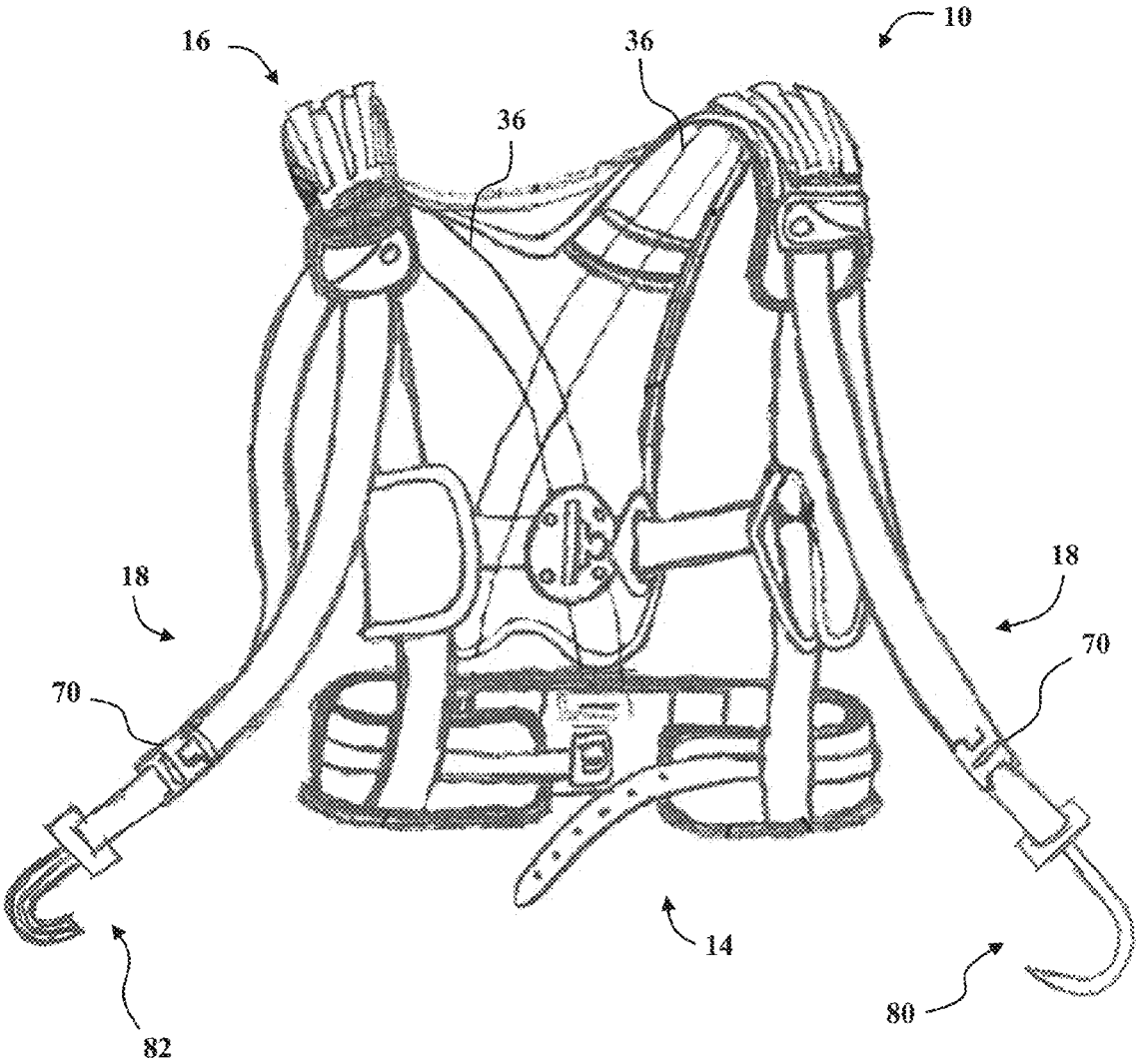
FIG. 3 is another front perspective view of the lifting assembly shown in FIG. 1, according to an embodiment of the present invention.
Figure 4:
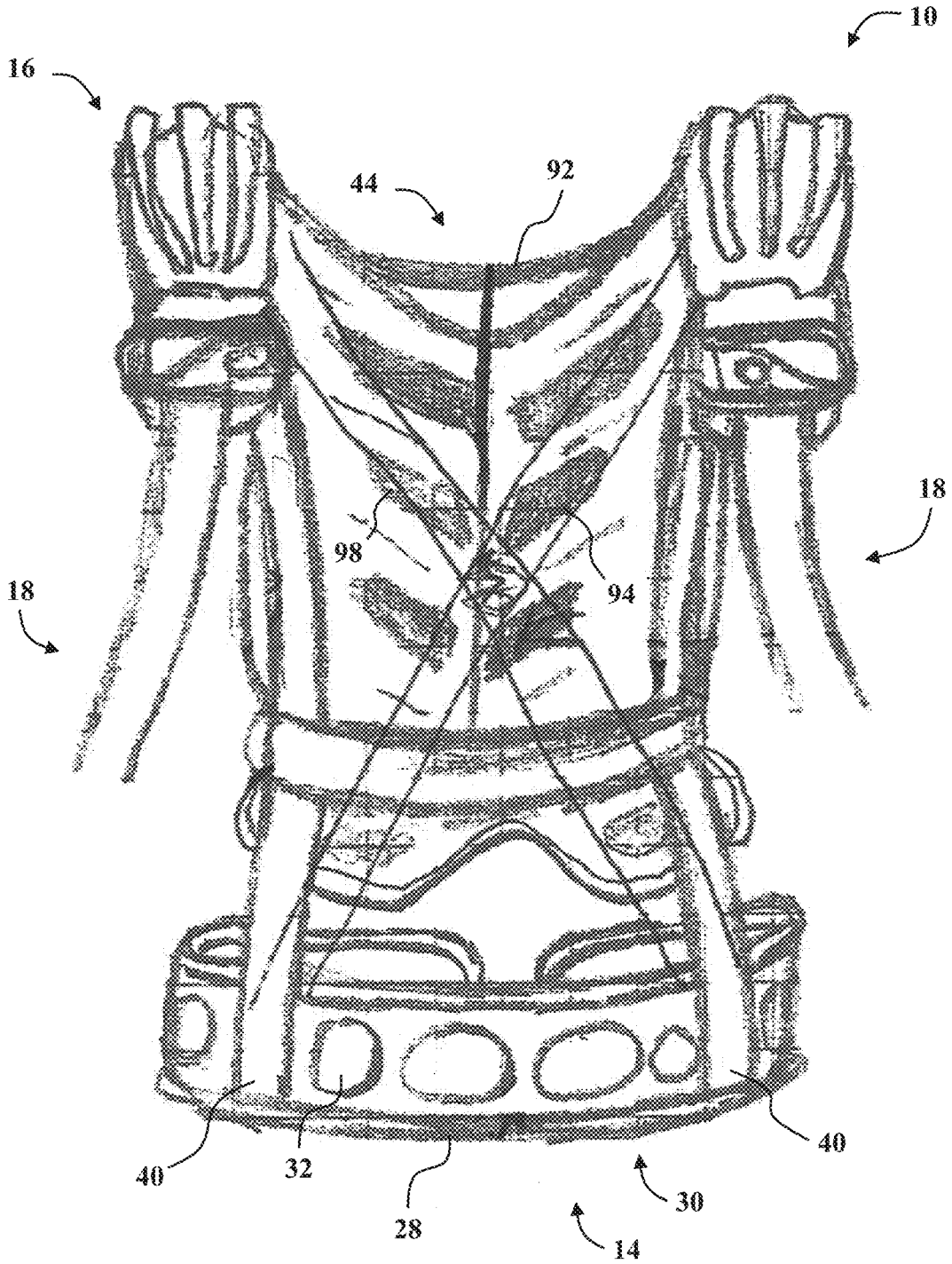
FIG. 4 is a rear view of the lifting assembly shown in FIG. 1.
Figure 10:
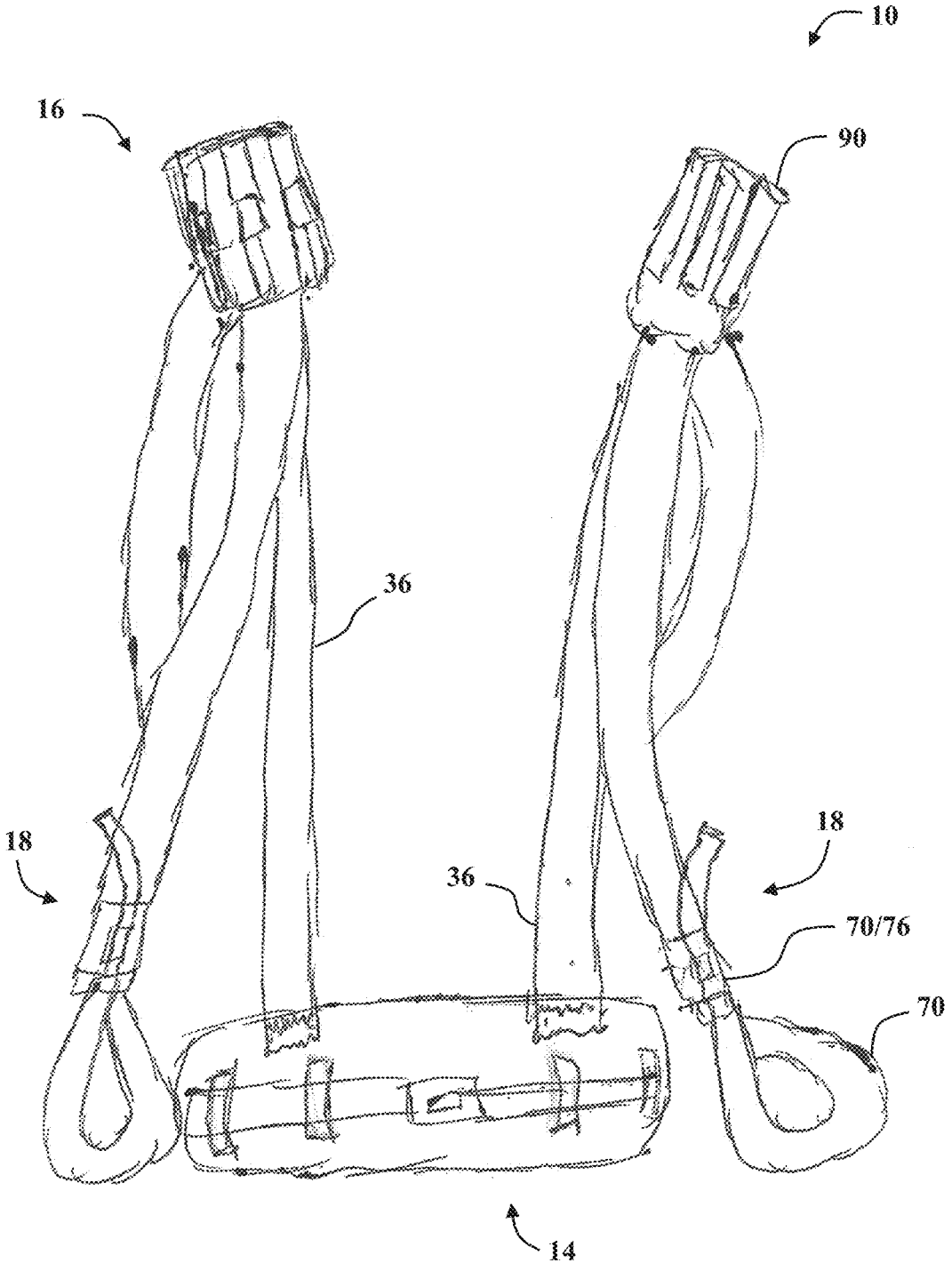
FIG. 10 is a front view of another embodiment of a lifting assembly that may be used with the safety vest shown in FIG. 7.
Figure 11:
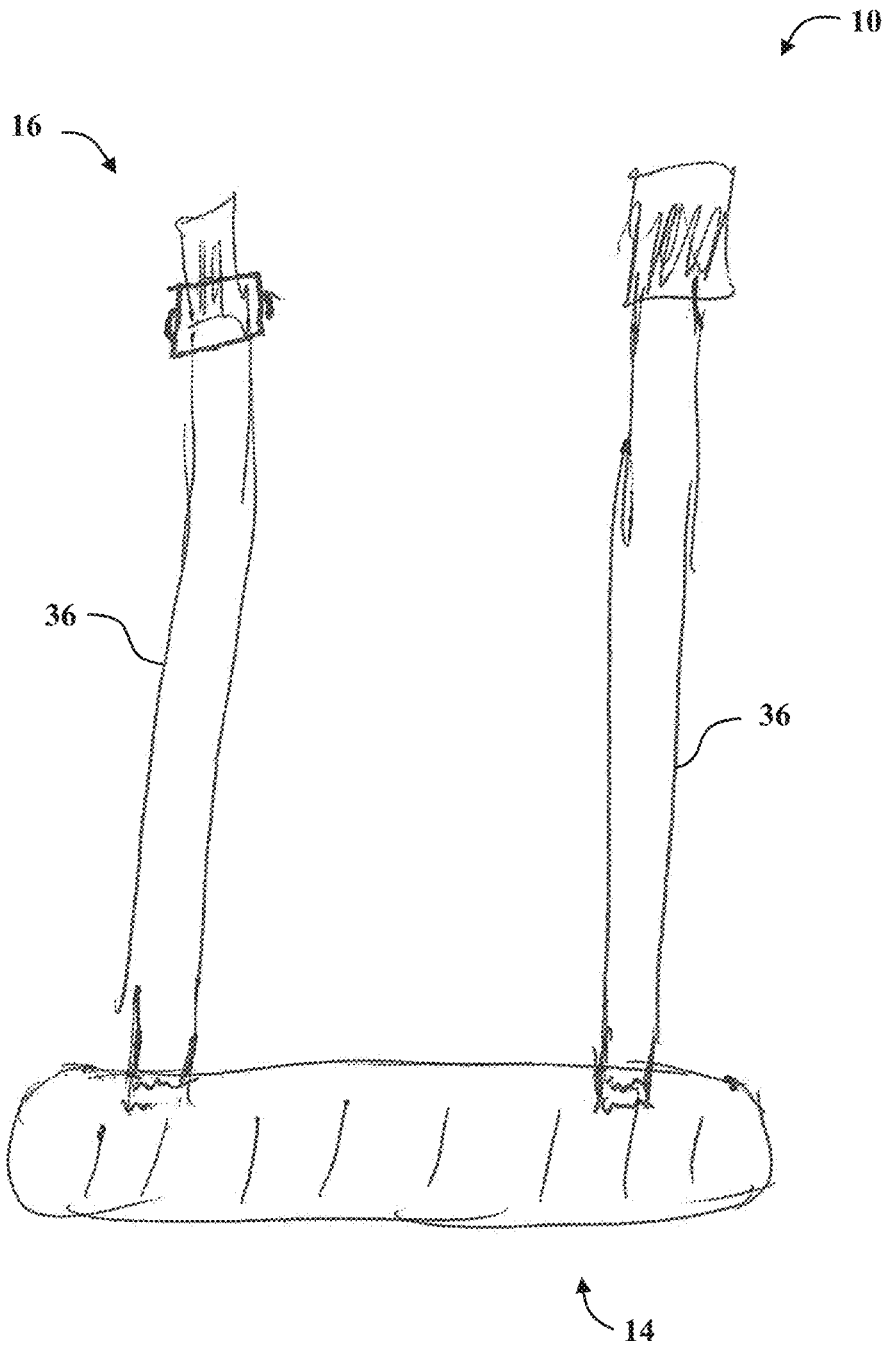
FIG. 11 is a rear view of the lifting assembly shown in FIG. 10.
Figure 12:
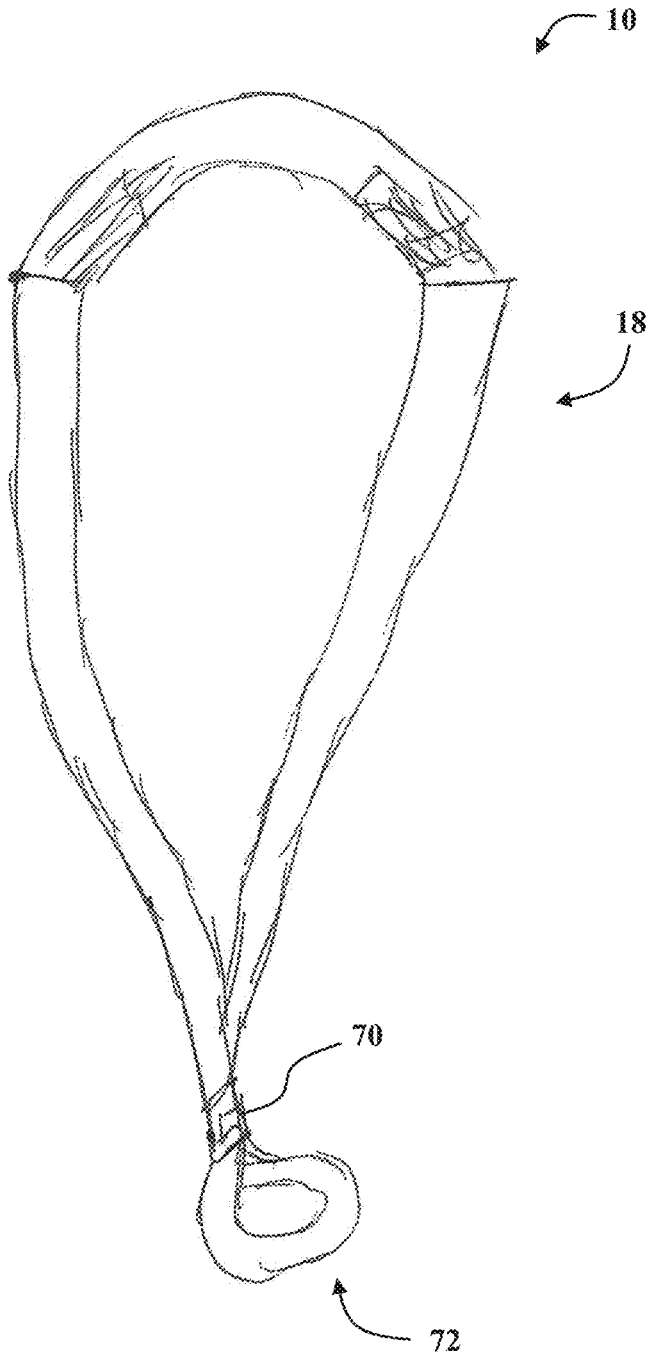
FIG. 12 is a side view showing a portion of the lifting assembly shown in FIG. 10.

In the illustrated embodiment, each lifting strap assembly 18 also includes attachment device 70 and a lifting device 72. The attachment device 70 is coupled to the first end 62 of the lifting strap 60. In one embodiment, the attachment device 70 includes a cam buckle 74 (shown in FIG. 6). The straps and attachments are connected to the cam buckle. The cam buckle may be used with multiple attachments that can be used. In another embodiment, the attachment device 70 includes a cinch buckle 76 (shown in FIG. 10). In the illustrated embodiment, the lifting device 72 is detachably coupled to the attachment device 70. Referring to FIG. 2, in one embodiment, the lifting device 72 includes a nylon strap loop 78 that includes an attachment portion that is coupled to the attachment device 70. As shown in FIG. 3, the lifting device 72 may also include a bailing hook 80, a rubber coated multi-purpose hook 82 and/or any suitable lifting tool that may be used with the lifting strap assembly 18. In one embodiment, the nylon lifting straps off the shoulders are attached to the cam buckle for the attachments leaving the user's hands free to support the object being lifted.

Figure 5:
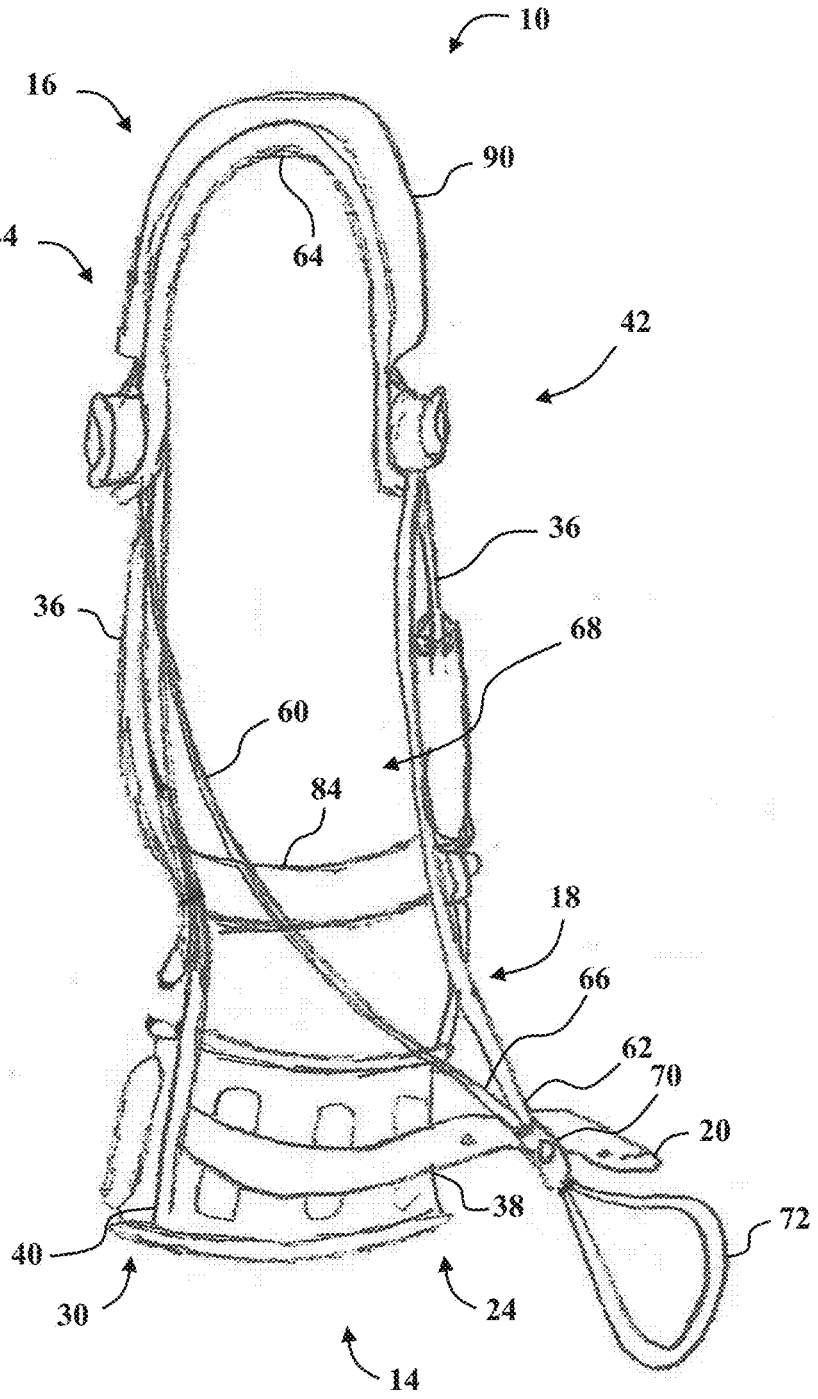
FIG. 5 is a side view of the lifting assembly shown in FIG. 1.
Figure 6:
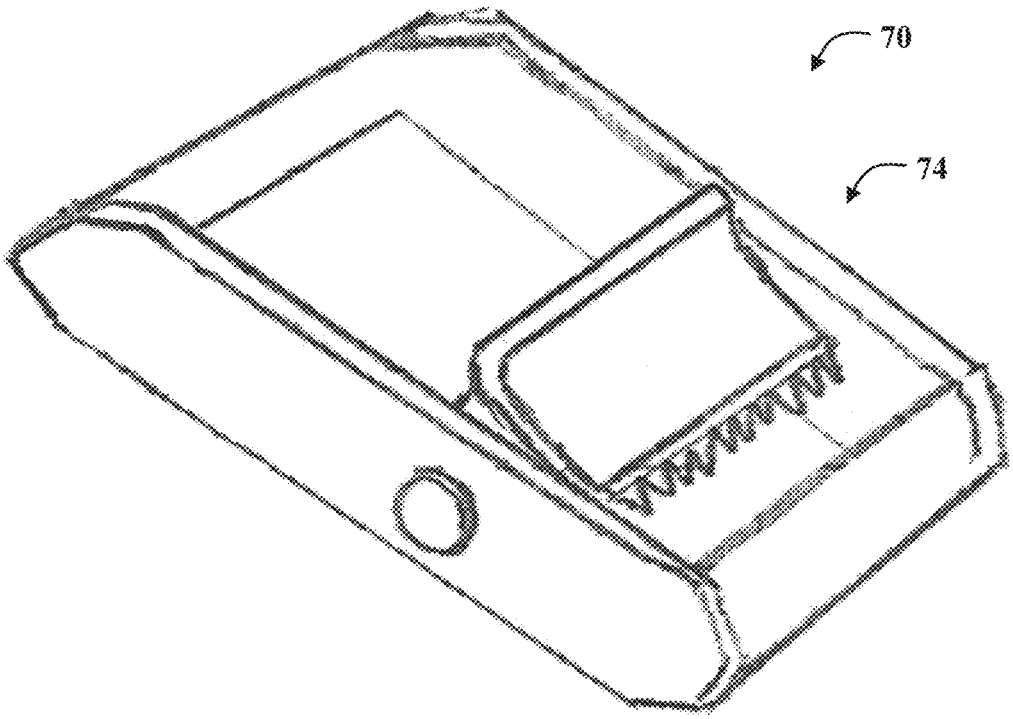
FIG. 6 is a perspective view of a cam buckle that may be used with the lifting assembly shown in FIG. 1.

In one embodiment, the lifting harness 10 includes a chest support assembly 84 that is coupled to the shoulder support assembly 16 and extends between the pair of shoulder support straps 36. The chest support assembly 84 includes a first chest support strap 86 that is detachably coupled to a second chest support strap 88. In one embodiment, the chest support assembly 84 includes a side release buckle attached to the first and second chest support straps to enable the user to couple the first chest support strap 86 to the second chest support strap 88 to provide additional lifting support to the user. Referring to FIG. 5, in one embodiment, each chest support strap is coupled to the rear portion 44 and the front portion 42 of the shoulder support assembly 16. For example, the first chest support strap 86 is coupled to the first shoulder support strap 46 at the rear portion 44 and the front portion 42 of the shoulder support assembly 16. Similarly, the second chest support strap 88 is coupled to the second shoulder support strap 52 at the rear portion 44 and the front portion 42 of the shoulder support assembly 16. In one embodiment, the chest support assembly 84 includes nylon straps that attached to both sides of the shoulder support assembly 16 and extend across the chest area of the user, and have adjustable lengths to fit everyone.

Figure 7:
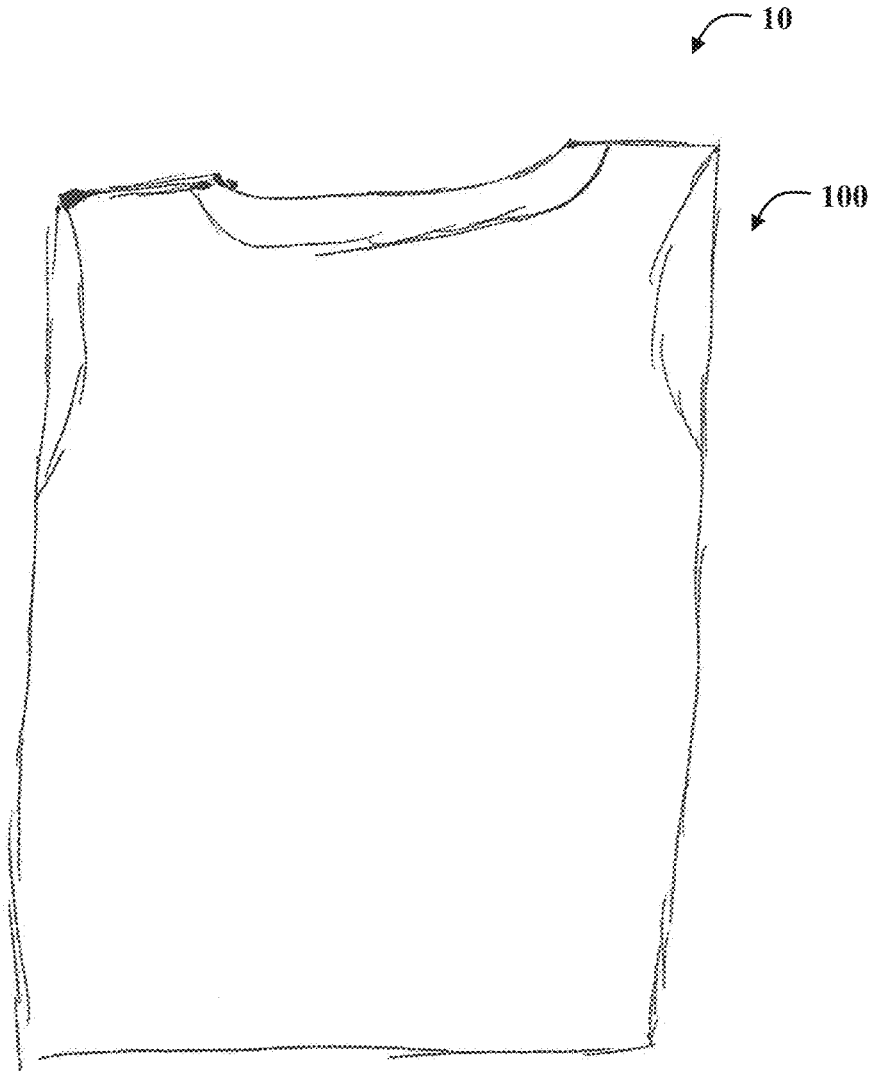
FIG. 7 is a front view of a safety vest including the lifting assembly shown in FIGS. 1 and 7, according to an embodiment of the present invention.

Referring to FIGS. 1-5, in the illustrated embodiment, the lifting harness 10 includes a pair of support pads 90 that are coupled to the shoulder support assembly 16. Each support pad 90 is coupled to a corresponding shoulder support strap 36 and includes a portion of the support pad 90 that is positioned between a corresponding shoulder of the user and the corresponding shoulder support strap 36. Each support pad 90 may include gel padding for the shoulders with mesh and reflective material to help with the weight being lifted. In addition, in one embodiment, each support pad 90 may include a gel-cushioned outer surface that overlays an outer surface of a corresponding shoulder support strap 36 and is adapted to support an armored vest (shown in FIGS. 7-9) thereon. In one embodiment, the nylon shoulder support straps are attached to the support waist belt and the shoulder pads.

In one embodiment, the lifting harness 10 may include a mesh covering fabric 92 that extends between the shoulder support straps 36 at the rear portion 44 of the shoulder support assembly 16. The covering fabric 92 may include a plurality of light reflective member 94 attached to an outer surface of the covering fabric 92 to reflect light and a plurality of gel-filled padded members 96. The back criss-cross shoulder support straps are attached to the shoulder pads and back support waist belt and are covered by mesh and reflective material. The mesh and reflective material with padding providing more protection when lifting.

Referring to FIGS. 7-12, in one embodiment, the lifting harness 10 may be coupled to a safety vest 100. The lifting harness 10 is coupled to an inner lining of the safety vest 100. For example, in one embodiment, each support pad 90 may include an outer surface that is coupled to the inner lining of the safety vest 100. In addition, an outer surface of each shoulder support strap 36 may be attached and/or sewn to the inner lining of the safety vest 100 at the rear portion 44 and/or the front portion 42 of the shoulder support assembly 16. In one embodiment, the safety vest 100 may include a military armored vest. Each support pad 90 may include a cushioned outer surface adapted to support the armored vest. The back support waist belt 14 may be attached to safety vest 100.

Figure 8:
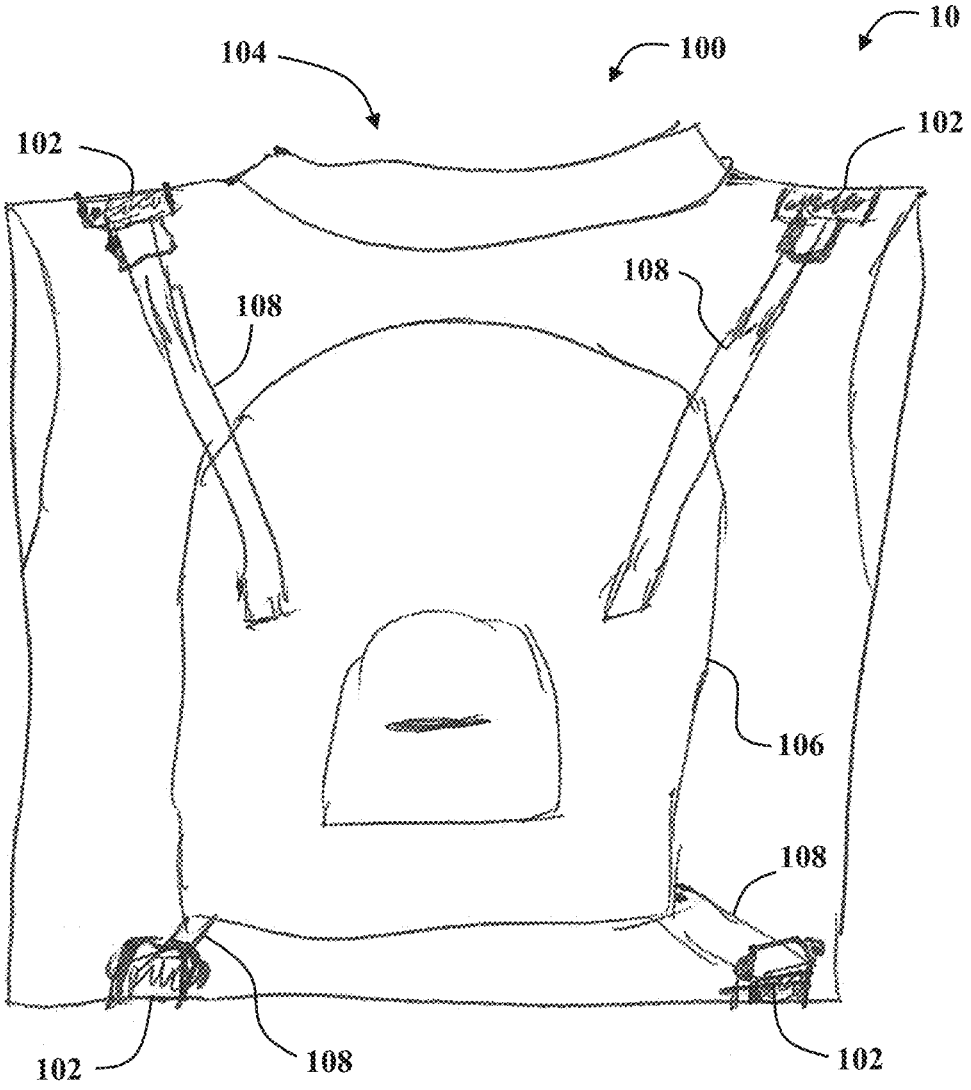
FIG. 8 is a rear view of the safety vest shown in FIG. 7.
Figure 9:
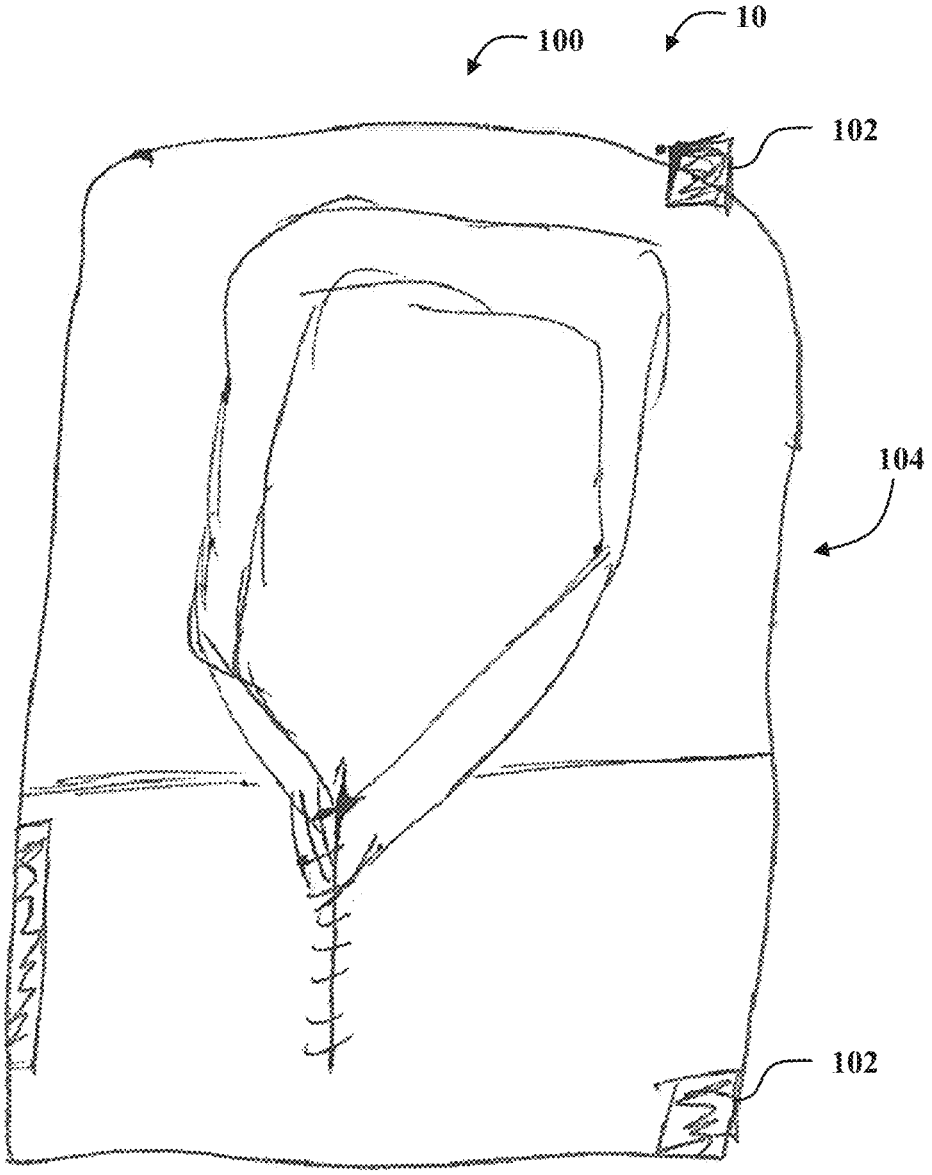
FIG. 9 is a side view of the safety vest shown in FIG. 7.

Referring to FIGS. 8-9, in one embodiment, the safety vest 100 may include a plurality of quick-release buckles 102 attached to a rear surface 104 of the safety vest 100 for attaching a backpack 106 to the safety vest 100. The backpack 106 may include a plurality of nylon straps 108 each having a corresponding quick release buckle attached to an end of the nylon strap for connecting the backpack to the corresponding quick-release buckles on the safety vest 100. The standard issued backpack 106 is attached to the quick release buckles 102.

Exemplary embodiments of a lifting harness are described above in detail. The apparatus is not limited to the specific embodiments described herein, but rather, components of the apparatus may be utilized independently and separately from other components and/or steps described herein. For example, the apparatus may also be used in combination with other lifting systems, and are not limited to practice with only the lifting harness as described herein. Rather, the exemplary embodiment can be implemented and utilized in connection with many other applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention may be practiced with modification within the spirit and scope of the claims.

What is claimed is:

1. A lifting harness comprising:

a waist belt adapted to extend around a waistline of a user;

a shoulder support assembly coupled to the waist belt and adapted to extend across each shoulder of the user, the shoulder support assembly including a pair of shoulder support straps, each shoulder support strap extending between a first end coupled to a front end of the waist belt and a second end coupled to a back end of the waist belt; and a pair of lifting strap assemblies coupled to the shoulder support assembly, each lifting strap assembly including:

a lifting strap coupled to a corresponding shoulder support strap, the lifting strap having a first end, a middle portion, and a second end, the middle portion coupled to the corresponding shoulder support strap and adapted to extend across a corresponding shoulder of the user, the first end being coupled to the second end to form a shoulder loop;

an attachment device coupled to the first end of the lifting strap; and a lifting device detachably coupled to the attachment device.

2. The lifting harness of claim 1, wherein each shoulder support strap includes the first end and the second end coupled to opposing sides of the waist belt such that the pair of shoulder straps are orientated parallel within a front portion of the shoulder support assembly and intersect within a rear portion of the shoulder strap assembly.

3. The lifting harness of claim 2, further comprising:

a covering fabric extending between the shoulder support straps at the rear portion of the shoulder strap assembly, the covering fabric including a plurality of reflective members attached to an outer surface of the covering fabric.

4. The lifting harness of claim 2, further comprising:

a chest support assembly coupled to the shoulder support assembly and extending between the pair of shoulder support straps, the chest support assembly including a first chest support strap detachably coupled to a second chest support strap.

5. The lifting harness of claim 3, wherein the first chest support strap is coupled to each shoulder support strap of the pair of shoulder support straps.

6. The lifting harness of claim 1, wherein the attachment device includes a cam buckle.

7. The lifting harness of claim 1, wherein the lifting device includes a nylon strap loop having an attachment portion coupled to the cam buckle.

8. The lifting harness of claim 1, further comprising:

a pair of support pads coupled to the shoulder support assembly, each support pad of the pair of support pads being coupled to a corresponding shoulder support strap and positioned between a corresponding shoulder of the user and the corresponding shoulder support strap.

9. The lifting harness of claim 8, wherein each support pad includes a cushioned outer surface adapted to support an armored vest.

10. The lifting harness of claim 1, wherein each of the shoulder support straps includes a 2-inch wide nylon strap and each of the lifting straps includes a 1-inch wide nylon strap.

11. A safety vest assembly comprising:

a safety vest; and a lifting harness coupled to an inner lining of the safety vest, the lifting harness including:

a waist belt adapted to extend around a waistline of a user;

a shoulder support assembly coupled to the waist belt and adapted to extend across each shoulder of the user, the shoulder support assembly including a pair of shoulder support straps, each shoulder support strap extending between a first end coupled to a front end of the waist belt and a second end coupled to a back end of the waist belt;

a pair of lifting strap assemblies coupled to the shoulder support assembly, each lifting strap assembly including:

a lifting strap coupled to a corresponding shoulder support strap, the lifting strap having a first end, a middle portion, and a second end, the middle portion coupled to the corresponding shoulder support strap and adapted to extend across a corresponding shoulder of the user, the first end being coupled to the second end to form a shoulder loop;

an attachment device coupled to the first end of the lifting strap; and a lifting device detachably coupled to the attachment device;

a pair of support pads coupled to the shoulder support assembly, each support pad of the pair of support pads being coupled to a corresponding shoulder support strap and positioned between a corresponding shoulder of the user and the corresponding shoulder support strap, each support pad including an outer surface coupled to the inner lining of the safety vest.

12. The safety vest assembly of claim 11, wherein each shoulder support strap includes the first end and the second end coupled to opposing sides of the waist belt such that the pair of shoulder straps are orientated parallel within a front portion of the shoulder support assembly and intersect within a rear portion of the shoulder strap assembly.

13. The safety vest assembly of claim 12, wherein an outer surface of each shoulder support strap is sewn to the inner lining of the safety vest at the rear portion and the front portion of the shoulder strap assembly.

14. The safety vest assembly of claim 12, further comprising:

a chest support assembly coupled to the shoulder support assembly and extending between the pair of shoulder support straps, the chest support assembly including a first chest support strap detachably coupled to a second chest support strap.

15. The safety vest assembly of claim 13, wherein the first chest support strap is coupled to each shoulder support strap of the pair of shoulder support straps.

16. The safety vest assembly of claim 11, wherein the attachment device includes a cam buckle.

17. The safety vest assembly of claim 1, wherein the lifting device includes a nylon strap loop having an attachment portion coupled to the cam buckle.

18. The safety vest assembly of claim 1, wherein the safety vest includes an armored vest, each support pad includes a cushioned outer surface adapted to support the armored vest.

19. The safety vest assembly of claim 11, wherein each of the shoulder support straps includes a 2-inch wide nylon strap and each of the lifting straps includes a 1-inch wide nylon strap.

20. A method of assembling a lifting harness, comprising the steps of:

providing a waist belt adapted to extend around a waistline of a user;

coupling a shoulder support assembly to the waist belt, the shoulder support assembly including a pair of shoulder support straps, each shoulder support strap extending between a first end coupled to a front end of the waist belt and a second end coupled to a back end of the waist belt; and coupling a pair of lifting strap assemblies to the shoulder support assembly, each lifting strap assembly including:

a lifting strap coupled to a corresponding shoulder support strap, the lifting strap having a first end, a middle portion, and a second end, the middle portion coupled to the corresponding shoulder support strap and adapted to extend across a corresponding shoulder of the user, the first end being coupled to the second end to form a shoulder loop;

an attachment device coupled to the first end of the lifting strap; and a lifting device detachably coupled to the attachment device.

* * * * *